US007961556B2

(12) United States Patent
Hirano et al.

(10) Patent No.: US 7,961,556 B2
(45) Date of Patent: Jun. 14, 2011

(54) DAY DISPLAY APPARATUS AND WATCH HAVING THE SAME

(75) Inventors: Kei Hirano, Chiba (JP); Tamotsu Ono, Chiba (JP)

(73) Assignee: Seiko Instruments Inc. (JP)

( * ) Notice: Subject to any disclaimer, the term of this patent is extended or adjusted under 35 U.S.C. 154(b) by 105 days.

(21) Appl. No.: 12/456,333

(22) Filed: Jun. 15, 2009

(65) Prior Publication Data

US 2009/0316534 A1 Dec. 24, 2009

(30) Foreign Application Priority Data

Jun. 16, 2008 (JP) ..... 2008-156629

(51) Int. Cl.
*G04B 19/20* (2006.01)

(52) U.S. Cl. ..... 368/38; 368/28

(58) Field of Classification Search ..... 368/34–38, 368/233

See application file for complete search history.

(56) References Cited

U.S. PATENT DOCUMENTS 3,713,287 A * 1/1973 Vogt et al. ..... 368/38
4,048,795 A * 9/1977 Risi ..... 368/38
4,081,950 A * 4/1978 Chappatte ..... 368/37
4,240,249 A * 12/1980 Malkin et al. ..... 368/28
4,261,047 A * 4/1981 Nakao ..... 368/38
4,271,493 A * 6/1981 Tamaru et al. ..... 368/28
6,118,734 A * 9/2000 Ray et al. ..... 368/37
6,744,696 B2 * 6/2004 Vernay et al. ..... 368/37
7,782,715 B2 * 8/2010 Crettex ..... 368/37
2002/0080686 A1 * 6/2002 Rochat et al. ..... 368/37
2004/0066711 A1 * 4/2004 Haefeli et al. ..... 368/101
2005/0169108 A1 * 8/2005 Watanabe ..... 368/37
2006/0028918 A1 2/2006 Groothuis et al. ..... 368/37
2006/0098535 A1 * 5/2006 Marki et al. ..... 368/37
2009/0303841 A1 * 12/2009 Noguchi ..... 368/37

* cited by examiner

*Primary Examiner* — Sean Kayes
(74) *Attorney, Agent, or Firm* — Adams & Wilks

(57) ABSTRACT

The present invention aims to provide a day display apparatus having less risk of occurrence of a day hopping even when an impact caused by a drop or the like is applied and a watch having the same. A day display apparatus of a watch includes a first day display wheel having a program tooth portion, a second day display wheel having a claw wheel portion and a gear portion, a jumper configured to perform a jump-and-stop operation with respect to the claw wheel portion, a day intermediate wheel engaging the gear portion, being rotated by the program tooth portion every time when the first day display wheel reaches a predetermined rotational position, and transmitting the rotation to the second day display wheel, and jump-and-stop control means configured to assume a rotation restrained position in which a jump-and-stop claw portion is restrained from coming apart from between the adjacent claw portions of the claw wheel portion when the jumper is at a rotation restrained state and assume a rotation allowing state in which the jump-and-stop claw portion is allowed to climb over the claw portion of the claw wheel portion every time when the first day display wheel reaches the predetermined rotational position and allows the second day display wheel to rotate.

19 Claims, 11 Drawing Sheets

WHEN DAY ADVANCEMENT IS STARTED
(WHEN DIGIT IS CARRIED UP)

WHEN DAY ADVANCEMENT IS STARTED
(WHEN DIGIT IS CARRIED UP)

WHEN SECOND DAY WHEEL IS NOT ADVANCED

WHEN SECOND DAY WHEEL IS ADVANCED

WHEN FIRST DAY WHEEL AND DAY INTERMEDIATE WHEEL ARE NOT IN ENGAGEMENT

WHEN DAY ADVANCEMENT IS STARTED
(WHEN DIGIT IS CARRIED UP)

DURING DAY ADVANCEMENT
(WHEN DIGIT IS CARRIED UP)

NORMAL STABILIZED STATE

WHEN DAY ADVANCEMENT IS STARTED
(WHEN DIGIT IS CARRIED UP)

DURING DAY ADVANCEMENT
(WHEN DIGIT IS CARRIED UP)

FIRST DAY WHEEL - STOPPER LEVER - SECOND DAY JUMPER IN ABUTMENT STATE

DAY DISPLAY APPARATUS AND WATCH HAVING THE SAME

BACKGROUND OF THE INVENTION

1. Field of the Invention

The present invention relates to a day display apparatus and a watch having the same.

2. Description of the Related Art

In watches, a day display apparatus configured to be able to display the date with large figures by rotating a second day display wheel which is jumped and stopped in rotation by a second day display wheel jumper and displays the date in the tens place every time when a first day display wheel which displays the date in the ones place reaches a predetermined rotational position, that is, a rotational position where the displayed date changes from 9 to 0 (that is, rotational positions where the date changes from 09 to 10, 19 to 20, and 29 to 30) or a rotational position where the displayed date changes from 31 to 01 by a program tooth portion is known (Patent Document JP-A-2005-214837, Patent Document JP-T-2006-522323).

In the display apparatus in Patent Document JP-A-2005-214837, the first day display wheel and the second day display wheel have gear portions positioned so as to oppose to each other in the radial direction with the intermediary of an annular area, and the program tooth portion of the first day display wheel is engaged with the gear portion of the second day display wheel via a day intermediate wheel positioned in the annular area. Therefore, in the display apparatus in Patent Document JP-A-2005-214837, when the program tooth portion is at a rotational position which does not allow the engagement with the day intermediate wheel, there is no member which controls the rotational position of the second day display wheel other than the second day display wheel jumper, so that there is a risk of occurrence of a date hopping when the restraint of the second day display wheel by the second day display wheel jumper is temporarily released by an impact due to a drop or the like and hence the second day display wheel is rotated.

In contrast, Patent Document JP-T-2006-522323 proposes a technology in which pins which are both positioned along the circumference and are able to enter into and exit from depressed portions of a wheel of an intermediate gear train which connects the first and second day display wheels are provided to increase the resistance of the wheel against the rotation so that the day display wheel is avoided from excessively rotating when the date is changed by manual rotation or the like and being displaced from the date position which should be normally displayed.

However, with the technology disclosed in Patent Document JP-T-2006-522323 as well, the restraint of the second day display wheel by the second day display wheel jumper is temporarily released due to the impact such as the drop and hence the second day display wheel is rotated, so that the risk of occurrence of the date hopping cannot be avoided reliably.

When the date hopping occurs as described above, the wrong date which is different from the date to be displayed is undesirably displayed.

SUMMARY OF THE INVENTION

It is an object of the present invention to provide a day display apparatus which has less risk of occurrence of a date hopping even when an impact due to a drop or the like is applied thereto, and a watch having the same.

In order to achieve the above-described object, a day display apparatus according to the present invention includes a first day display wheel having a program tooth portion, a second day display wheel having a claw wheel portion and a gear portion being rotatable coaxially with respect to the first day display wheel, a second day display wheel jumper having a jump-and-stop claw portion and a spring portion, the jump-and-stop claw portion performing a jump-and-stop operation with respect to the claw wheel portion of the second day display wheel under an action of the spring portion, a day intermediate wheel engaging the gear portion of the second day display wheel and being configured to be rotated by the program tooth portion of the first day display wheel every time when the first day display wheel reaches a predetermined rotational position and transmit the rotation to the second day display wheel, and a jump-and-stop control means which assumes a rotation restrained state which restrains the jump-and-stop claw portion from coming apart from between adjacent claw portions of the claw wheel portion when the jump-and-stop claw portion of the second day display wheel jumper is in a rotation restrained position of being fitted between the adjacent claw portions of the claw wheel portion of the second day display wheel and assumes a rotation allowing state which allows the jump-and-stop claw portion to come apart from the adjacent claw portions of the claw wheel portion and climb over the claw portion of the claw wheel portion so as to allow the rotation of the second day display wheel every time when the first day display wheel reaches the predetermined rotational position.

In the day display apparatus according to the present invention, since the "jump-and-stop control means which assumes a rotation restrained state which restrains the jump-and-stop claw portion from coming apart from between adjacent claw portions of the claw wheel portion when the jump-and-stop claw portion of the second day display wheel jumper is in the rotation restrained position of being fitted between the adjacent claw portions of the claw wheel portion of the second day display wheel and assumes a rotation allowing state which allows the jump-and-stop claw portion to come apart from between the adjacent claw portions of the claw wheel portion and climb over the claw portion of the claw wheel portion so as to allow the rotation of the second day display wheel every time when the first day display wheel reaches the predetermined rotational position" is provided, the jump-and-stop control means is set to a jump allowing state every time when the first day display wheel reaches the predetermined rotational position to allow the jump-and-stop claw portion of the second day display wheel jumper to come apart from between the adjacent claw portions of the claw wheel portion of the second day display wheel and climb over the claw portion to allow the rotation of the second day display wheel on one hand, and the jump-and-stop control means mechanism assumes a restrained state when the jump-and-stop claw portion of the second day display wheel jumper is at a rotation restrained position of being fitted between the adjacent claw portions of the claw wheel portion of the second day display wheel to restrain or prohibit the rotation of the second day display wheel on the other hand.

In other words, according to the day display apparatus in the present invention, 'when the first day display wheel is at positions other than the "predetermined rotational position", the jump-and-stop control means is set to the restrained state to restrain the jump-and-stop claw portion of the second day display wheel jumper from coming apart from between the adjacent claw portions of the claw wheel portion of the second day display wheel to restrain or prohibit the rotation of the second day display wheel. According to the day display apparatus in the present invention, '"when the first day display wheel is at positions other than the "predetermined rotational position"', since the rotation of the second day display wheel is prohibited, there is less risk of occurrence of the date hopping even when the impact such as the drop is applied.

According to the day display apparatus in the present invention, typically, the first day display wheel includes a cam portion having an arcuate portion and a depressed portion, the jump-and-stop control means includes the cam portion and a jump-and-stop control mechanism, the jump-and-stop control mechanism assumes the rotation restrained position when the jump-and-stop control means assumes the rotation restrained state, the jump-and-stop control mechanism assumes a rotation allowing position when the jump-and-stop control means assumes the rotation allowing state, the jump-and-stop control mechanism being at the rotation restrained position engages the arcuate portion of the cam portion to restrain the jump-and-stop claw portion of the second day display wheel jumper from coming apart from between the adjacent claw portions of the claw wheel portion of the second day display wheel, the jump-and-stop control mechanism being at the rotation allowing position engages the depressed portion of the cam portion to cause the jump-and-stop claw portion of the second day display wheel jumper to come apart from between the adjacent claw portions of the claw wheel portion of the second day display wheel and allows the second day display wheel to rotate.

In other words, the jump-and-stop control means may be formed of a single member, for example, the second day display wheel jumper may be composed to directly engage the cam portion, but typically, the second day display wheel jumper engages the cam portion via the jump-and-stop control mechanism.

According to the day display apparatus, the jump-and-stop control mechanism being at the rotation restrained position engages the arcuate portion of the cam portion to restrain the jump-and-stop claw portion of the second day display wheel jumper from coming apart from between the adjacent claw portions of the claw wheel portion of the second day display wheel, while the jump-and-stop control mechanism being at the rotation allowing position engages the depressed portion of the cam portion to cause the jump-and-stop claw portion of the second day display wheel jumper to come apart from between the adjacent claw portions of the claw wheel portion of the second day display wheel and allows the second day display wheel to rotate. In other words, in this day display apparatus, 'when the first day display wheel is at positions other than the "predetermined rotational position", the jump-and-stop control mechanism is set to the rotation restrained position by the cam portion, so that the jump-and-stop claw portion of the second day display wheel jumper is retrained from coming apart from between the adjacent claw portions of the claw wheel portion of the second day display wheel, thereby restraining or prohibiting the rotation of the second day display wheel. Therefore, in this day display apparatus, as in the case described above, 'when "the first day display wheel is at positions other than the "predetermined rotational position"', since the rotation of the second day display wheel is prohibited, there is less risk of occurrence of the day hopping even when the impact such as the drop is applied.

According to the day display apparatus in the present invention, typically, the program tooth portion of the first day display wheel opposes the gear portion of the second day display wheel via an annular area, and the day intermediate wheel is positioned in the annular area so as to transmit the rotation of the first day display wheel every time when reaching the predetermined rotational position to the second day display wheel, and the jump-and-stop control mechanism includes a stopper member having a cam engaging portion engaged with the arcuate portion of the cam member at the rotation restrained position and engaged with the depressed portion of the cam portion at the rotation allowing position and a jumper jump-and-stop claw engaging portion positioned at a portion opposing the back surface side of the jump-and-stop claw portion of the second day wheel jumper.

In this case, the cam engaging portion of the stopper lever is engaged with the depressed portion of the cam portion every time when the first day display wheel reaches the predetermined rotational position and hence the jump-and-stop control mechanism is set to the rotation allowing position, so that the jump-and-stop claw portion of the second day display wheel jumper comes apart from between the adjacent claw portions of the claw wheel portion of the second day display wheel and is allowed to climb over the claw portion, thereby allowing the rotation of the second day display wheel. Also, in this case, when the first day display wheel is at positions other than the "predetermined rotational position", the cam engaging portion engages the arcuate portion of the cam portion and hence the jump-and-stop control mechanism is set to the restrained position, so that the jump-and-stop claw portion of the second day display wheel jumper is restrained from coming apart from between the adjacent claw portions of the claw wheel portion of the second day display wheel, thereby restraining or prohibiting the rotation of the second day display wheel. Accordingly, 'when the first day display wheel is at a position other than the "predetermined rotational position"', since the rotation of the second day display wheel is prohibited, there is less risk of occurrence of the day hopping even when the impact such as the drop is applied.

However, in the day display apparatus of the present invention, instead of the configuration in which "the program tooth portion of the first day display wheel opposes the gear portion of the second day display wheel via the annular area, and the day intermediate wheel is positioned in the annular area so as to transmit the rotation of the first day display wheel every time when reaching the predetermined rotational position to the second day display wheel", for example, a configuration in which both of the first and second day display wheels are positioned on an outer peripheral side so as to leave actually circular areas insides thereof, the day intermediate wheel positioned in the circular area is rotated by the internal gear-shaped program tooth portion of the first day display wheel, and the rotation is transmitted to the internal-gear shaped gear portion of the second day display wheel is also applicable.

In this case as well, the configuration such that the restrained position is assumed by engaging the arcuate portion of the cam portion and the rotation allowing position is assumed by engaging the depressed portion of the cam portion is the same. Here, the stopper member is typically a rigid member having no internal structure. However, if desired, the jump-and-stop control mechanism may have an internal structure having a plurality of parts which may be relatively displaced.

In the description given above, the predetermined rotational position is not a point, but an area.

In the description given above, the day intermediate wheel may be a gear train including a plurality of gears instead of being composed of a single wheel.

According to the day display apparatus in the present invention, typically, the stopper member allows the jump-and-stop claw portion of the second day display wheel jumper to retract and climb over the claw portion of the claw wheel portion of the second day display wheel when assuming the rotation allowing position of being engaged with the depressed portion of the cam portion, and restrains the retraction of the back surface of the jump-and-stop claw portion of the second day display wheel jumper and retrains the jump-and-stop claw portion from climbing over the claw portion of the claw wheel portion of the second day display wheel when assuming the restrained position of being engaged with the arcuate portion of the cam portion.

According to the day display apparatus in the present invention, typically, the stopper member is rotatable between the rotation restrained position and the rotation allowing position. However, if desired, the stopper member may be linearly reciprocable or non-arcuately and non-linearly reciprocable, for example. Preferably, the center of rotation or the range of rotation is selected so that the engaging portion with respect to the cam portion of the stopper member and the engaging portion with respect to the jump-and-stop claw portion move in the radial direction of the first and second day display wheels or in the direction close thereto. However, if desired, it may be a slanting direction with respect to the radial direction.

According to the day display apparatus in the present invention, typically, the stopper member is rotatable between the rotation restrained position and the rotation allowing position, and the stopper member includes an elongated hole for guiding the displacement of the stopper member in such a manner that the jumper jump-and-stop claw engaging portion and the cam engaging portion are displaced in the radial direction when the stopper member is rotated. In this case, guiding of the stopper member is achieved easily, and also restraining and allowing the rotation of the second day display wheel are reliably achieved.

According to the day display apparatus in the present invention, typically, the cam engaging portion has a pin-shape elongated in the direction of thickness of the first day display wheel. In this case, engagement and disengagement with respect to the cam portion are reliably achieved, so that control of the operation in association with the engagement and the disengagement is reliably achieved.

According to the day display apparatus in the present invention, typically, the jumper jump-and-stop claw engaging portion has a pin-shape elongated in the direction of thickness of the second day display wheel. In this case as well, the engagement and the disengagement with respect to the cam portion are reliably achieved, so that control of the operation in association with the engagement and the disengagement is reliably achieved.

According to the day display apparatus in the present invention, typically, the first day display wheel includes a claw wheel, and the claw wheel of the first day display wheel is restrained by a first day display wheel jumper. In the case of the first day display wheel, for example, even though there is a little risk of the date hopping although not much because the restraint of rotation by the engagement of a day correcting gear train exists and the engagement with a day advancing claw even though it is intermittent, according to the day display apparatus in the present invention, since the jump-and-stop control mechanism is provided and the jump-and-stop control mechanism typically includes the stopper member such as the stopper lever as described above, the stopper member itself is able to restrain not only the date hopping of the second day display wheel but also the date hopping of the first day display wheel to an extent in fact.

According to the day display apparatus in the present invention, typically, the first day display wheel displays the ones place of the date, and the second day display wheel displays the tens place of the date. However, as shown in Patent Document 2, other types of display are also applicable.

A watch according to the present invention typically includes the day display apparatus as described above.

DESCRIPTION OF THE PREFERRED EMBODIMENTS

Figure 1:
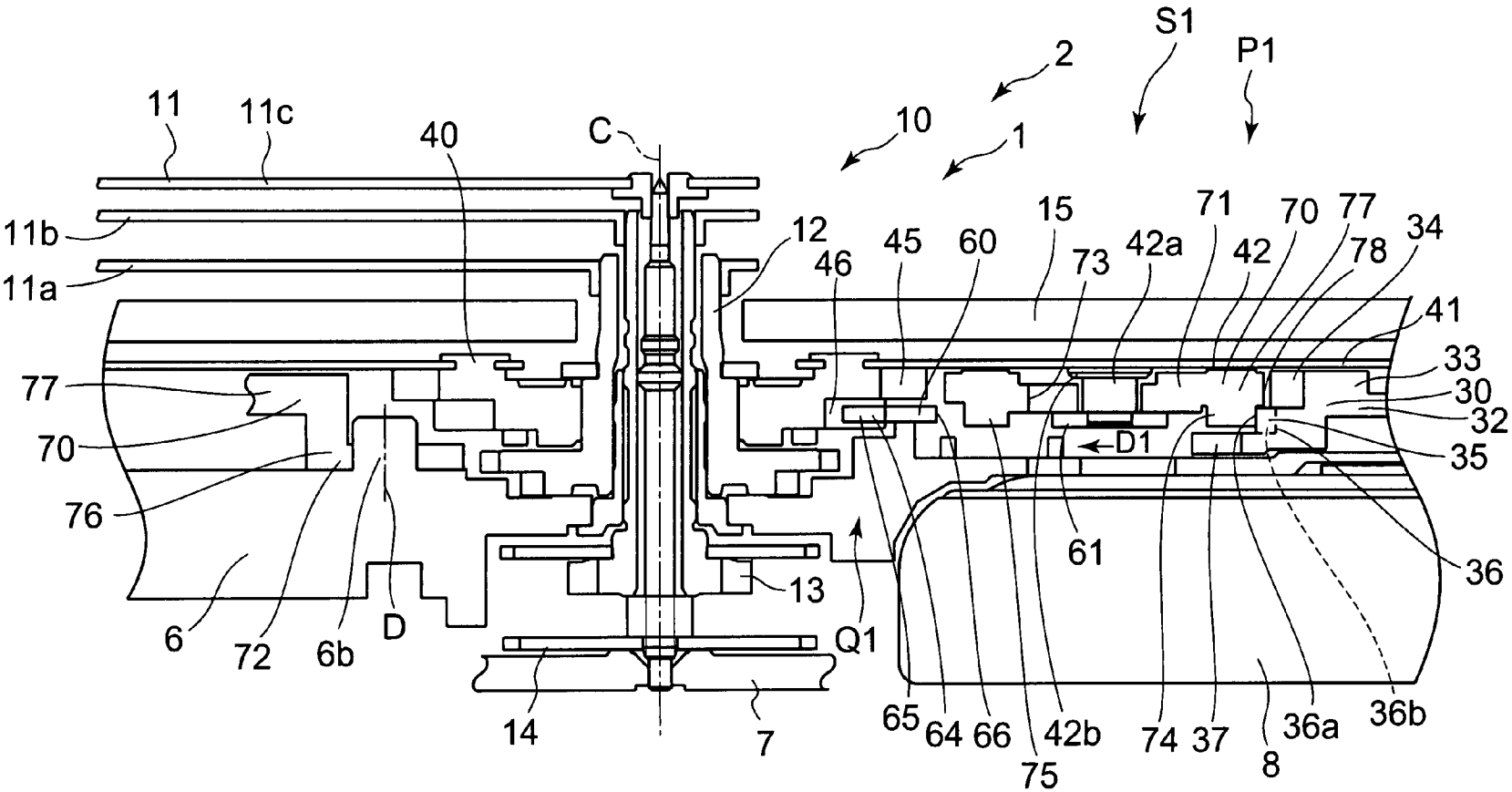
FIG. 1 is an explanatory cross-sectional drawing showing a state in which a second day wheel is not rotated in a watch having a day display apparatus according to a preferred embodiment of the present invention (a portion on the left side from the rotational center axis in FIG. 1 shows a cross section taken roughly along the line IIIA-IIIA in FIG. 3, and a portion on the right side from the rotational center axis in FIG. 1 shows a cross section taken roughly along the line IIIB-IIIB in FIG. 3)

Subsequently, a preferred embodiment of the present invention will be described on the basis of the preferred embodiment shown in the attached drawings.

Example

As is understood from the explanatory cross-sectional view (for example, FIG. 1), and from an explanatory plan view (for example, FIG. 3), a watch 2 having a day display apparatus 1 according to a preferred embodiment of the present invention includes a watch gear train 10 supported by a plate-shaped supporting member such as a main plate 6 or a gear train receiver (not shown). The watch gear train 10 includes an hour wheel (cylindrical wheel) 12 having an hour hand 11*a* attached thereto, a minute wheel 13 having a minute hand 11*b* attached thereto, and a second wheel 14 having a second hand 11*c* attached thereto. The hour wheel 12, the minute wheel 13, and the second wheel 14 are lined with each other via a gear train portion, not shown, of the watch gear train 10. Arranged behind the time display hands 11 including the hour hand 11*a*, the minute hand 11*b*, and the second hand 11*c* rotatable around a center axis C is a dial 15, and the day display apparatus 1 is arranged between the main plate 6 and the dial 15. The dial 15 includes a day display window 16 (see FIG. 3, and so on) which displays the date. Arranged on the side of a back lid of the main plate 6 is a battery 8 and the like.

The day display apparatus 1 includes a first day wheel 30 configured to display a first digit from the right of the date (the value of the date in the ones place) and a second day wheel 40 configured to display a second digit from the right of the date (the value of the date in the tens place).

Figure 3:
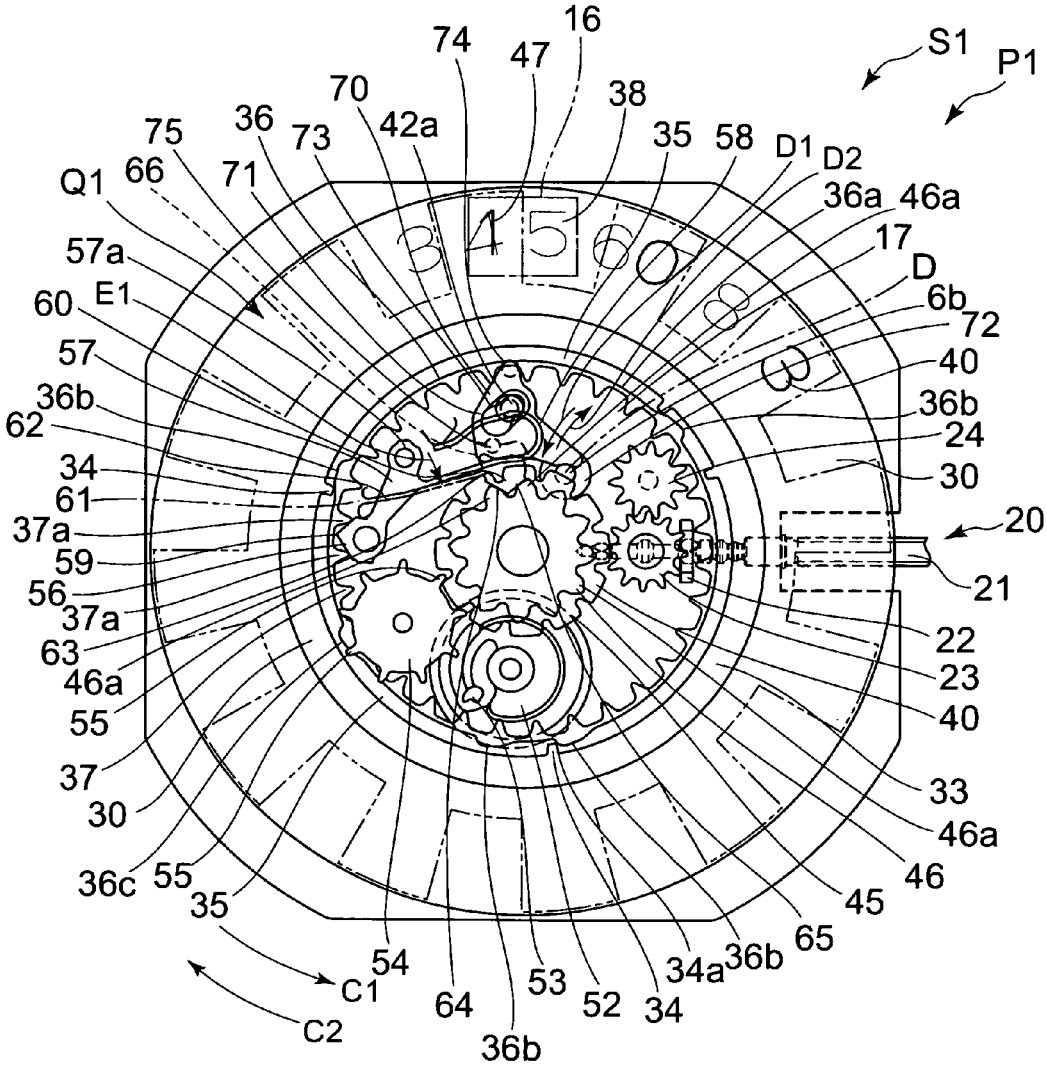
FIG. 3 is an explanatory plan view viewing along the line III-III of the watch in FIG. 1 at timing when the rotation of the second day wheel does not occur.

As is understood from FIG. 1 and FIG. 3, for example, the first day wheel 30 includes a body 31 which has an annular shape as a whole and is supported between the main plate 6 and the dial 15 so as to be rotatable around the center axis C.

Figure 6:
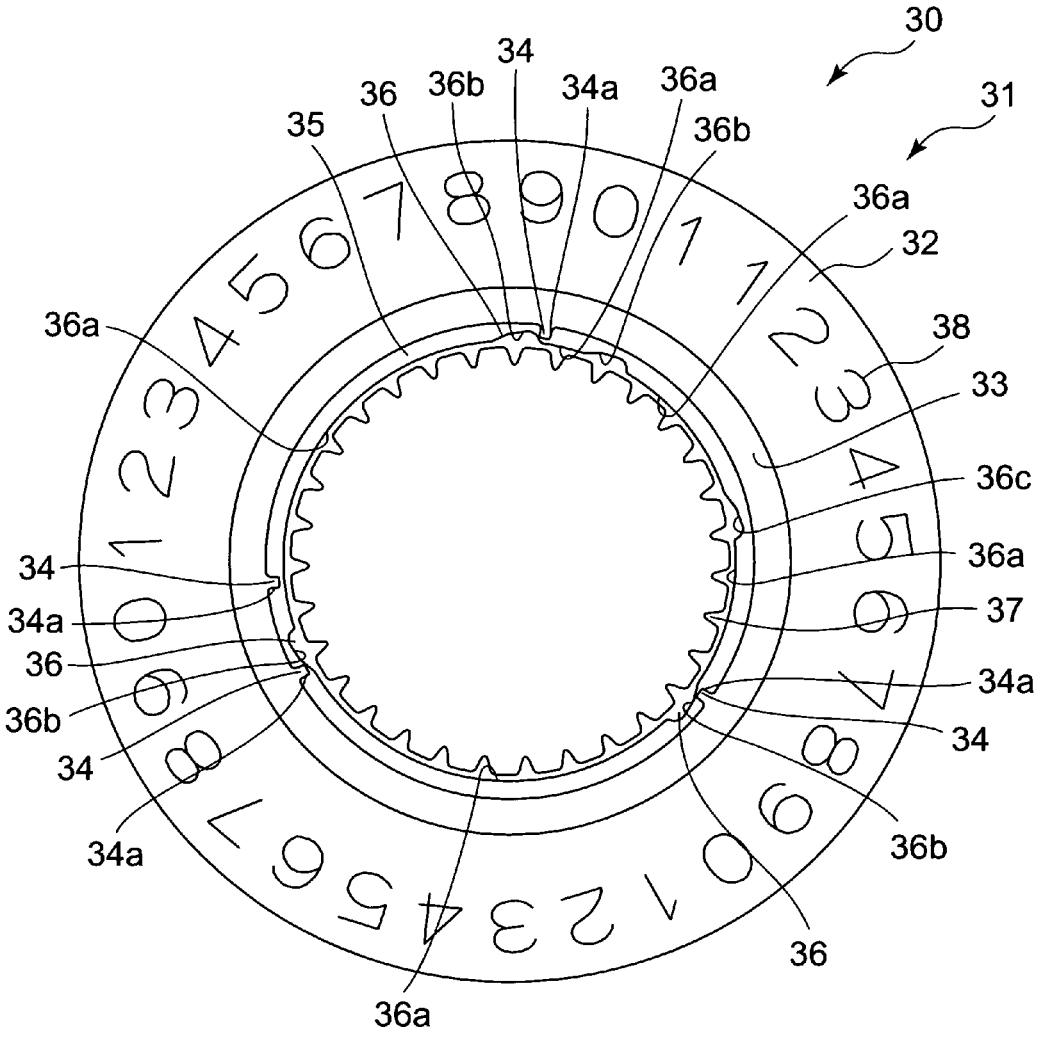
FIG. 6 is an explanatory plan view of the first day wheel of the watch shown in FIG. 1.

As is understood from FIG. 6 in addition to FIG. 1 and FIG. 3, the annular body 31 includes a first date display portion 32 having a disk shape provided on the outer peripheral side, a thick annular portion 33 provided in-between, a second day wheel advancing tooth portion 34 as a program tooth portion formed on the inner peripheral edge of the intermediate thick annular portion 33 on the side closer to the dial 15 in terms of the thickness direction, a cam forming annular portion 35 projecting radially inwardly from the intermediate thick annular portion 33 at a portion nearer to the back lid than the intermediate thick annular portion 33 and having a cam surface 36 on the inner peripheral surface thereof, and a first day wheel gear portion 37 formed radially inwardly on the nearest side to the back lid in terms of the direction of thickness.

The first date display portion 32 is provided with thirty-one figures (date) 38 indicating the first digit from the right of the date from among thirty one dates from 01 to 31 marked clockwise at a regular pitch. Since the number of figures to be marked is smaller than the case in which all the dates from 1 to 31 on one day wheel, the FIG. 38 may be displayed in a larger scale.

The second day wheel advancing tooth portion 34 as the program tooth portion of the first day wheel 30 is configured to function as a second day wheel advancing tooth for rotating the second day wheel 40 when the digit of the date on the first date display portion 32 of the first day wheel 30 is carried up from "9" to "0", or when the date display is changed from "31" to "1" at the beginning of the month, and typically, includes a projecting tooth portion 34*a* as shown in the drawing. The second day wheel advancing tooth portion 34 may be of any other shapes or structures as long as it is configured to rotate the second day wheel 40 every time when the first day wheel 30 reaches a specific rotational position.

The cam surface 36 of the cam forming annular portion 35 of the first day wheel 30 includes an arcuate portion 36*a* most part of which is positioned along a circle around the center axis C and is formed with depressed portions 36*b* at several points of the arcuate portion 36*a* as undercut portions of the stopper lever. The depressed portions 36*b* constitute the undercuts where a projecting portion of the stopper lever, described later, is fitted so as to allow the rotation of the second day wheel 40 every time when the first day wheel 30 reaches a specific rotational position. In the example shown in FIG. 6, and so on, a depressed portion 36*c* at a different angular position, having an actually similar shape as the depressed portion 36*b*, is a stopper lever undercut portion for assembly. The depressed portion 36*c* does not necessarily have to be provided, and hence the depressed portion 36*c* is ignored in the description of the operation or the like given below.

A first day wheel gear portion 37 of the first day wheel 30 is either engageable with a day advancing claw 18 at the tooth portions 37*a* thereof so as to be rotated by a day advancing claw 53 (FIG. 3, and so on) when the normal hand movement and the like, or directly engages a day correcting gear 24 so as to be rotated by the day correcting gear 24 of a day correcting mechanism 20 at the time of day correction.

The day correcting mechanism 20 includes a first calendar correcting wheel 22, a second calendar correcting wheel 23, and the day correcting wheel 24 and, when a winding stem 21 is at a predetermined pulled-out position, transmits the rotation of the winding stem 21 to the first day wheel gear portion 37 of the first day wheel 30 via the first calendar correcting wheel 22, the second calendar correcting wheel 23 and the day correcting wheel 24.

As is understood from FIG. 1 and FIG. 3, for example, the second day wheel 40 includes a plate-shaped body 41 which has an annular shape as a whole and is supported between the main plate 6 and the dial 15 so as to be rotatable around the center axis C in the same manner as the first day wheel 30, and a center annular member 44 which engages the inner peripheral edge of the plate-shaped body 41 for supporting the plate-shaped body 41.

Figure 7:
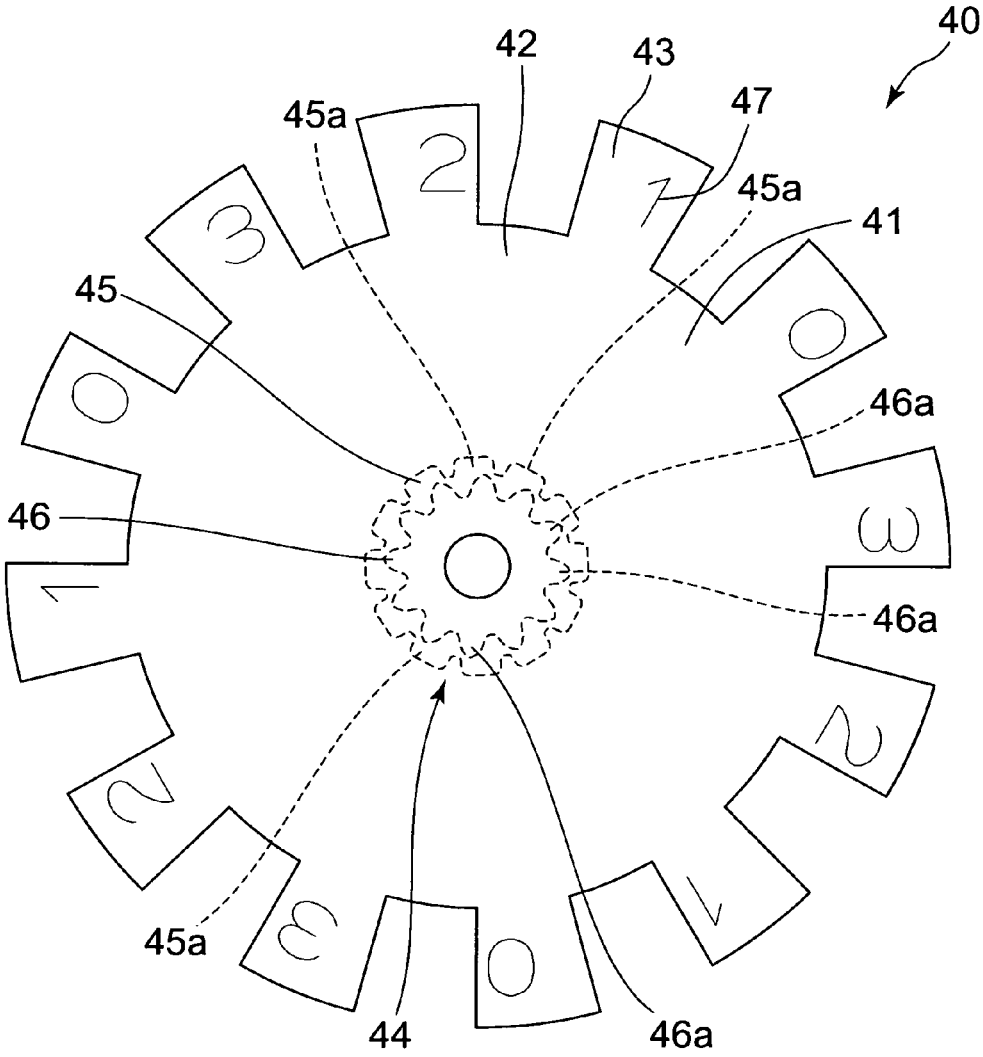
FIG. 7 is an explanatory plan view of the second day wheel of the watch shown in FIG. 1.

As is understood from FIG. 7 in addition to FIG. 1 and FIG. 3, the plate-shaped body 41 includes an annular plate-shaped portion 42 on the radially center side and second date display portions 43 being projected radially at a regular angular distance on the outer peripheral side of the annular plate-shaped portion 42. The center annular member 44 is formed of a thick annular member and includes a driven gear portion 45 positioned on the side close to the dial 15 and engaged with a day intermediate wheel 54, and a jump-and-stop claw wheel portion 46 positioned on the side close to the main plate 6 on the outer peripheral portion thereof. In this example, the driven gear portion 45 has a larger diameter than the jump-and-stop claw wheel portion 46. However, the diameters may be vice versa.

On the second date display portion 43, four figures from 0 to 3 (date) 47 indicating the date in the tens place (second digit from the right) are marked three times in repetition in the counterclockwise direction at a regular pitch in the same scale as the FIG. 38 on the first date display portion 32.

The day display apparatus 1 includes a day turning wheel 52, the day intermediate wheel 54, a first day wheel jumper 56, and a second day wheel jumper 60 in addition to the first and second day wheels 30, 40, and includes a stopper lever 70 as a jump-and-stop control mechanism. In this example, the jump-and-stop control means includes the cam surface 36 of the cam forming annular portion 35 of the first day wheel 30 and the stopper lever 70.

The day turning wheel 52 is rotated according to the rotation of the hour wheel 12, engages the adjacent tooth portions 37*a* of the gear portion 37 of the first day wheel 30 with the day advancing claw 53 once a day, and rotates the first day wheel 30 by one pitch (corresponding to one day) in a direction C1 (counterclockwise) to increment the date in the ones place (first digit from the right) by one.

The day intermediate wheel 54 includes a tooth portion 55 engaging the driven gear portion 45 of the second day wheel 40 on the outer periphery thereof. The projecting tooth portion 34*a* of the second day wheel advancing tooth portion 34 which constitutes the program gear of the first day wheel 30 engages the day intermediate wheel 54 every time when the first day wheel 30 reaches the predetermined rotational position, and rotates the day intermediate wheel 54. Therefore, the day intermediate wheel 54 rotates the second day wheel 40 engaged with the driven gear portion 45 by the tooth portion 55 in a direction C2 (clockwise) to increment the date in the tens place (second digit from the right) by one.

The first day wheel jumper 56 is rotatably attached to the main plate 6 at a proximal end portion 57*a* of a jumper body 57, and is pressed against a nip between the tooth portions 37*a*, 37*a* of the gear portion 37 of the first day wheel 30 by a jump-and-stop claw portion 59 on the distal end side of the jumper body 57 by a resilient bias force of a proximal end side spring portion 58 so that the rotation in the direction C1 of the first day wheel 30 is restrained.

Figure 2:
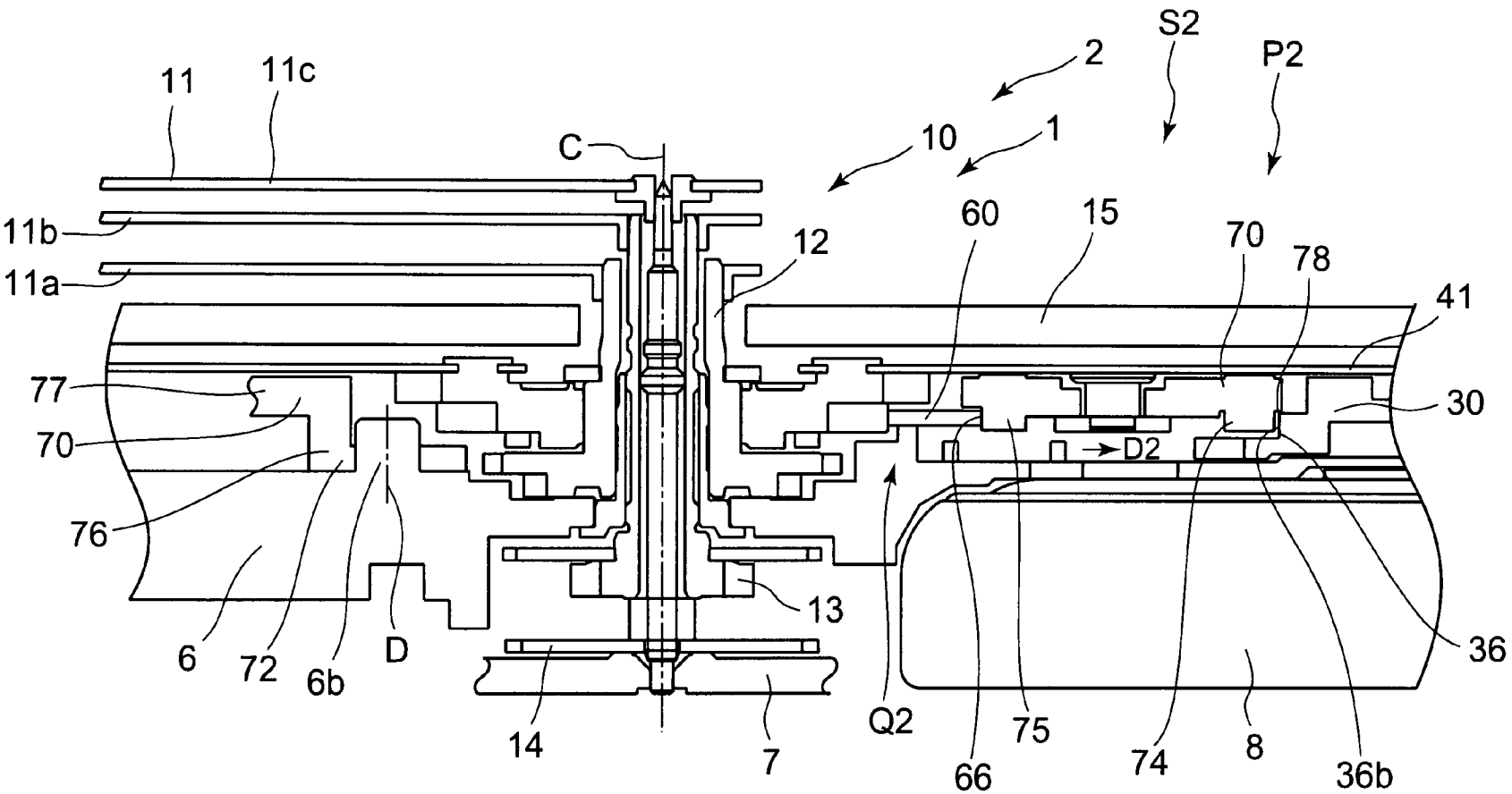
FIG. 2 is an explanatory cross-sectional drawing like FIG. 1, showing a state in which the second day wheel in the watch shown in FIG. 1 is in rotation.
Figure 8:
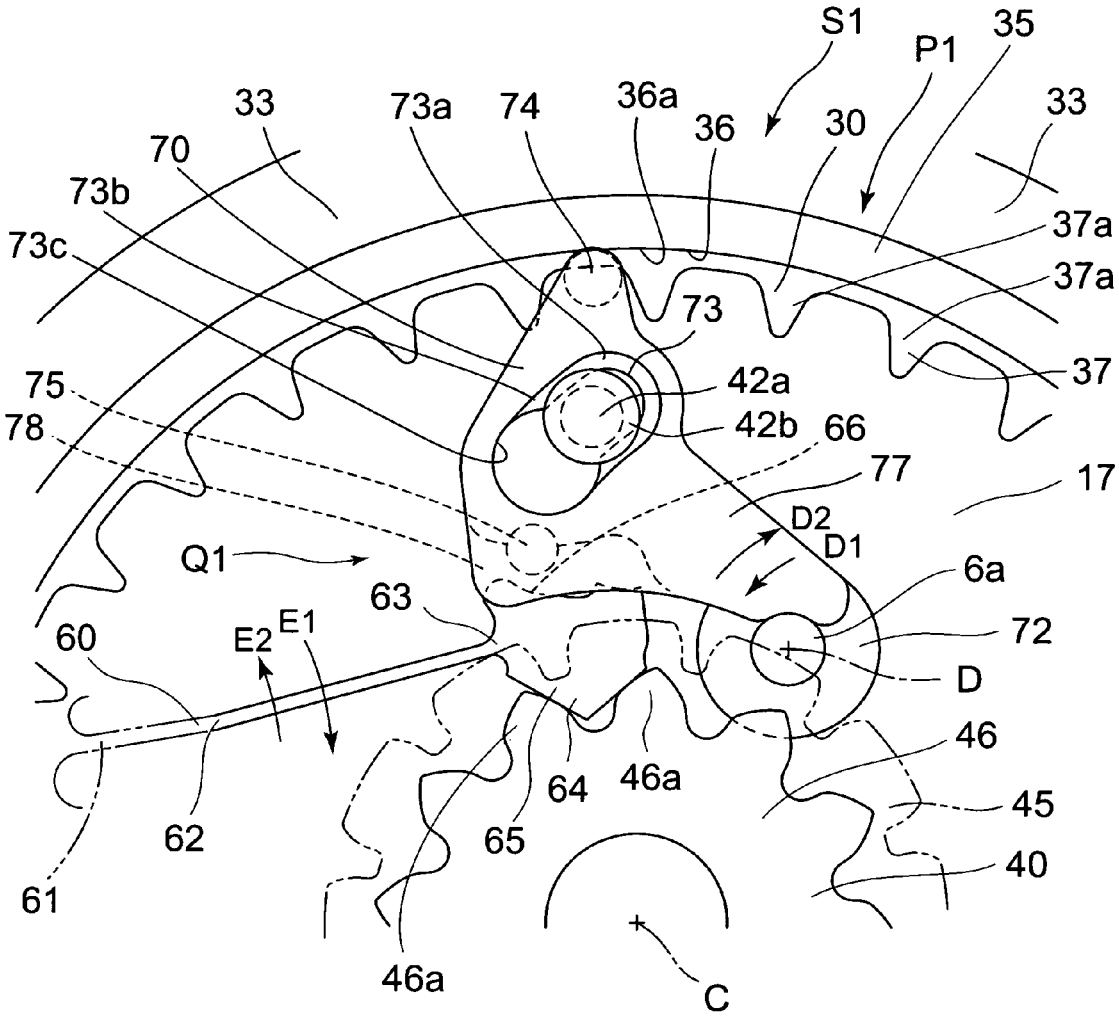
FIG. 8 is an explanatory plan view showing a portion of the day display apparatus according to the preferred embodiment of the present invention in a state shown in FIG. 3 in an enlarged scale (however, a gear portion of the second day wheel which engages a day intermediate wheel is indicated by an imaginary line for facilitating understanding of a joining relation)

As is understood from FIG. 8, which shows a part of FIG. 3 in an enlarged scale in addition to FIG. 1 to FIG. 3, the second day wheel jumper 60 includes a spring portion 62 supported by the main plate 6 on the proximal end 61 side and a jump-and-stop claw portion 64 formed integrally on a distal end 63 side of the spring portion 62. The jump-and-stop claw portion 64 includes a jump-and-stop claw body 65 positioned on the side opposing the jump-and-stop claw wheel portion 46 of the second day wheel 40 and an engaging edge portion 66 positioned on the back surface side of the jump-and-stop claw body 65, that is, the side opposite from the side opposing the second day wheel jump-and-stop claw wheel portion 46 of the second day wheel 40, and receives a bias force in a direction E1 by the spring portion 62. The spring portion 62 and the proximal end portion 61 of the second day wheel jumper 60 has actually a more complex shape in many cases, however, it is expressed by a simple line and detail description is omitted here for the simplification of the drawing.

In the second day wheel jumper 60, the jump-and-stop claw body 65 is fitted between adjacent claw portions 46*a*, 46*a* of a jump-and-stop claw wheel portion 46 of the second day wheel 40 under the action of a resilient force of the spring portion 62 in the direction E1 to restrain the rotation of the second day wheel 40 in the direction C2.

The stopper lever 70 in this example includes an integral lever member 71, and the lever member 71 is fitted to a pin-type shaft portion 6*b* projecting from the main plate 6 in a boss portion 72 and is rotatable in directions D1, D2 around the pin-type shaft portion 6*b*, and includes an elongated hole 73 which loosely fits the pin-type projecting portion 42*a* projecting from the proximal end portion 61 of the second day wheel jumper 60 and allows or guides the rotation thereof in the directions D1, D2 within a desired range. In this example, as is understood from FIG. 1 and FIG. 8, which is an enlarged view, the pin-type projecting portion 42*a* includes a flange portion 42*b* for preventing coming-apart at the distal end thereof, and the elongated hole 73 has a peripheral groove portion 73*a* for receiving the flange portion 42*b* on the peripheral wall of the elongated hole 73 on the side of the dial and, in addition, as is understood from FIG. 8, the elongated hole 73 includes a large diameter hole portion 73*c* for assembly which allows insertion of the flange portion 42*b* on the side of one end portion 73*b* thereof. When it is configured to fix the flange portion 42*b* later, the large diameter hole portion 73*c* does not have to be provided. The lever member 71 may be an assembly having a plurality of components.

As is understood from FIG. 1, FIG. 3, FIG. 8, and so on, the lever member 71 is arranged approximately in an annular area 17 between the first day wheel 30 and the center annular member 44 of the second day wheel 40, and includes an outer pin-type engaging portion 74 as a cam engaging portion which engages the cam surface 36 of the first day wheel 30 and is able to be fitted and engaged with the depressed portions 36*b*, and the inner pin-type engaging portion 75 as a jumper jump-and-stop claw engaging portion which is engageable with the engaging edge portion 66 on the back surface side of the jump-and-stop claw body 65 of the second day wheel jumper 60. As is understood from FIG. 1, the lever member 71 includes the boss portion 72 coming into abutment with the main plate 6, a rising portion 76 extending from the boss portion 72 toward the dial 15 in the direction of thickness, and a lever body 77 extending along the back surface of the plate-shaped body 41 of the second day wheel 40 on the side close to the dial 15, and is provided integrally with the outer and inner pin-type engaging portions 74, 75 on the surface of the plate-shaped lever body 77 on the back lid side. In an area of the surface of the body 77 of the lever member 71 on the back lid side close to the pin-type engaging portion 75 and closer to the center C with respect to the inner pin-type engaging portion 75, a notch 78 for allowing the approach of the engaging edge portion 66 of the jump-and-stop claw portion 64 of the second day wheel jumper 60 toward the pin-type engaging portion 75 is formed.

Figure 5:
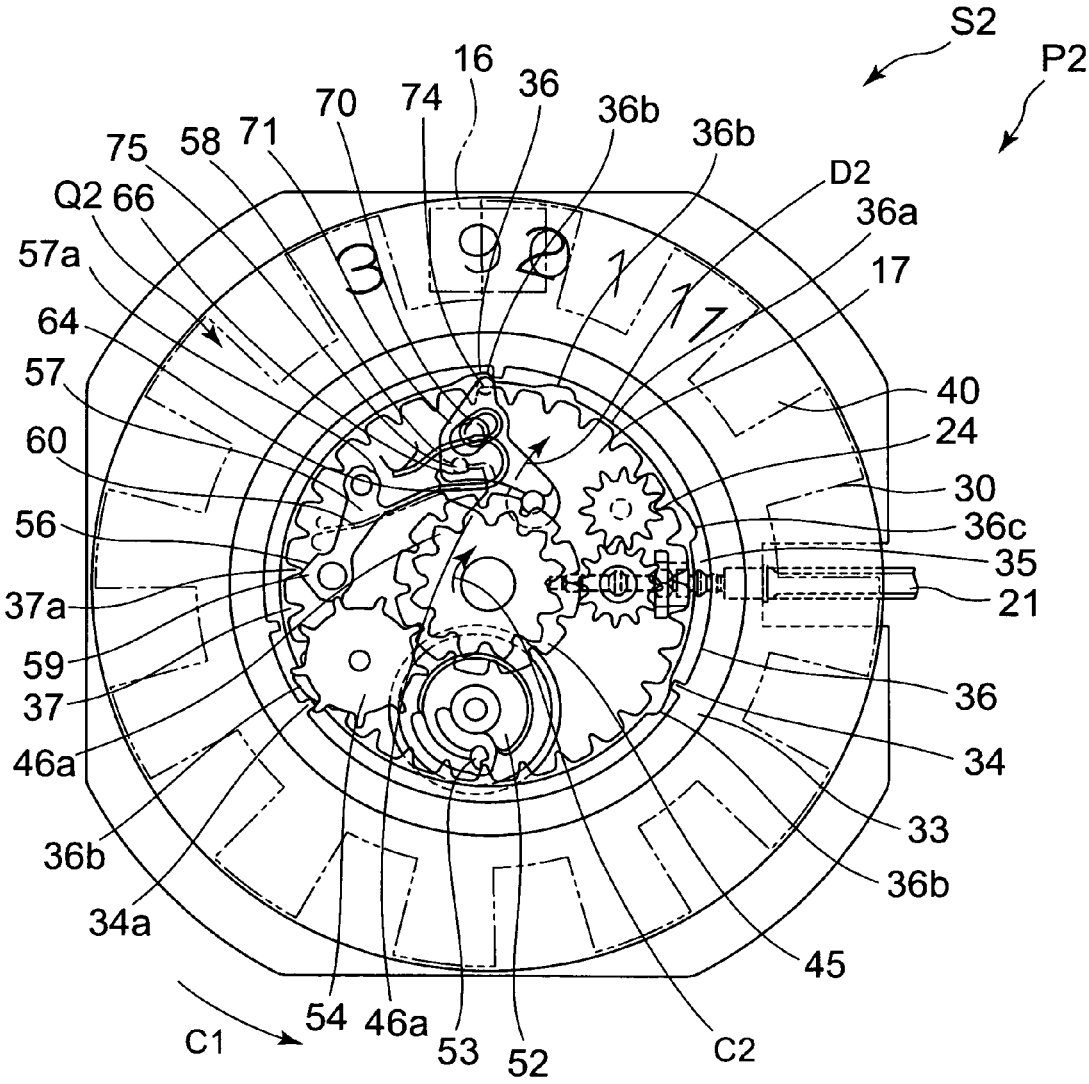
FIG. 5 is an explanatory plan view showing a state in which the second day wheel is in advancement (in rotation) like in FIG. 3 viewing along the line V-V of the watch shown in FIG. 2. and shows, an explanatory plan view of a state in which a day advancement with a carry-up of the digit is started.
Figure 10:
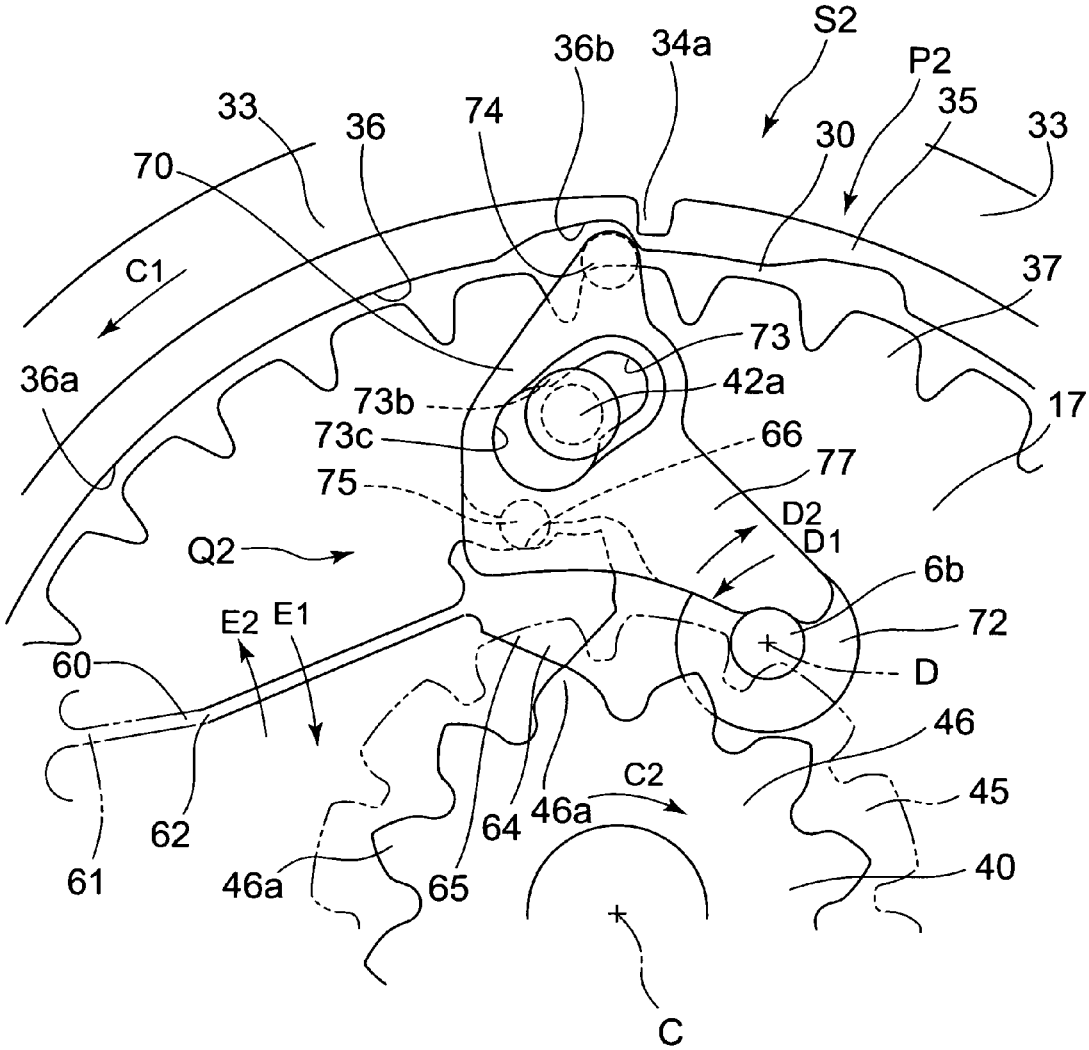
FIG. 10 is an enlarged explanatory drawing as in FIG. 8 showing a state in which the second day wheel is in advancement (rotation) as in FIG. 5.

More specifically, the stopper lever 70 is rotatable in the directions D1, D2 around the center axis D of the pin-type projecting portion 42*a* between a second day wheel rotation prohibited (restrained) position P1 which is the position rotated in the direction D1 to the maximum (FIG. 1, FIG. 3, FIG. 8, and so on), and a second day wheel rotation allowing position P2 which is the position rotated in the direction D2 to the maximum (FIG. 2, FIG. 5, FIG. 10, and so on).

In the second day wheel rotation prohibited (restrained) position P1, the stopper lever 70 is in a state in which the outer pin-type engaging portion 74 of the lever member 71 thereof engages the arcuate portion 36*a* of the cam surface 36 of the first day wheel 30 so that the entire part is rotated in the direction D1, and the inner pin-type engaging portion 75 also assumes a position of being rotated in the direction D1. At this time, the jump-and-stop claw portion 64 of the second day wheel jumper 60 assumes a state Q1 of being fitted deeply between the adjacent claw portions 46*a*, 46*a* of the jump-and-stop claw wheel portion 46 of the second day wheel 40, and the stopper lever 70 engages the engaging edge portion 66 on the back surface side of the jump-and-stop claw portion 64 of the second day wheel jumper 60 in the state Q1 with the inner pin-type engaging portion 75. In other words, when the stopper lever 70 is at the second day wheel rotation prohibited (restrained) position P1, the second day wheel jumper 60 is at the second day wheel rotation restrained state Q1 and a state S1 in which the rotation of the second day wheel 40 is restrained.

Figure 11:
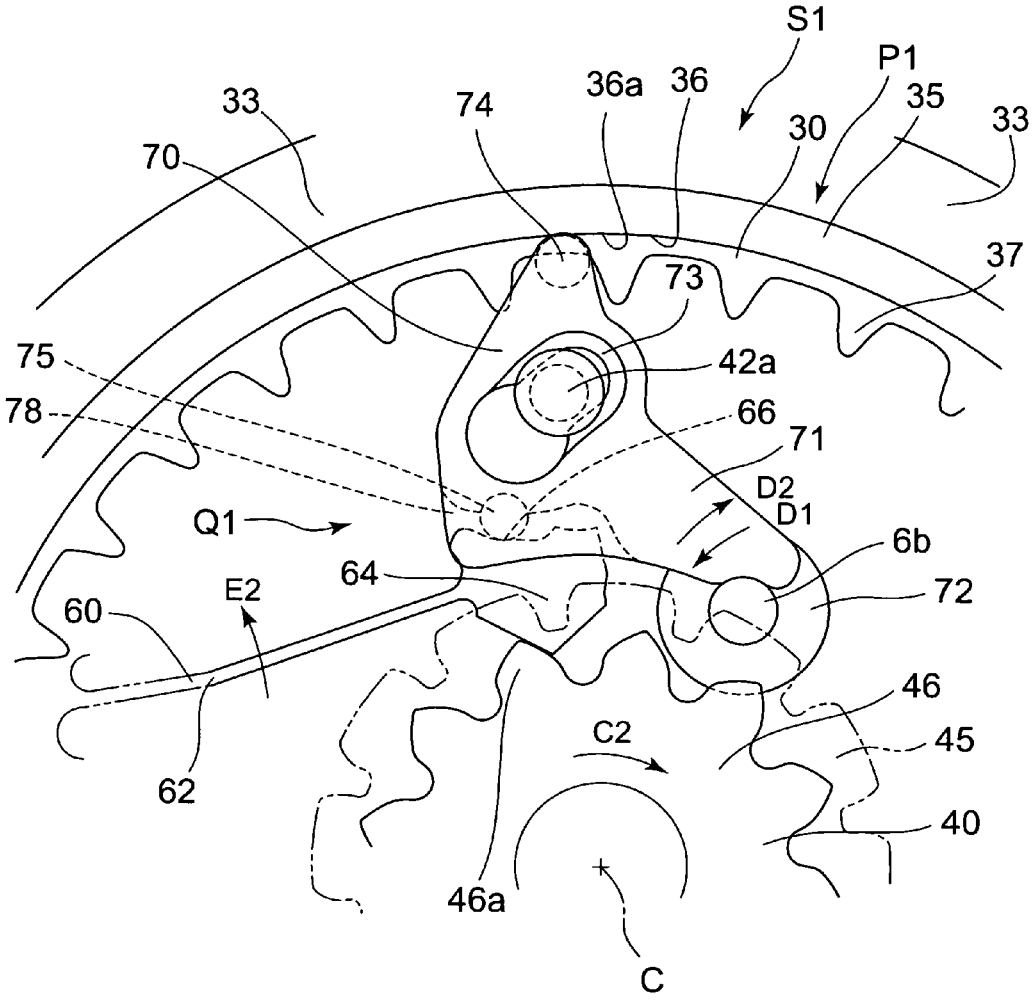
FIG. 11 is an enlarged explanatory plan view as in FIG. 8 showing the restraint of rotation of the stopper lever in the case in which an external force for forcedly rotating the second day wheel is applied in the state in FIG. 8.

In this state S1, even though an attempt is made to forcedly rotate the second day wheel 40 in the direction C2, when the engaging edge portion 66 of the jump-and-stop claw portion 64 of the jumper 60 is displaced in a direction E2 in association with the movement of a one side edge 65*a* of the body 65 of the jump-and-stop claw portion 64 of the second day wheel jumper 60 climbing over the claw portion 46*a* along the side edge of the claw portion 46*a* of the claw wheel portion 46 according to the rotation of the jump-and-stop claw wheel portion 46 of the second day wheel 40 in the direction C2 as shown in FIG. 11, the engaging edge portion 66 comes into abutment with the inner pin-type engaging portion 75 of the stopper lever 70. Here, since the displacement of the stopper lever 70 in the direction D2 is prohibited by the arcuate portion 36*a* of the cam surface 36 of the first day wheel 30, further displacement of the engaging edge portion 66 of the jumper 60 in the direction E2 is also prohibited, so that the further rotation of the jump-and-stop claw wheel portion 46 in the direction C2 is prohibited. Therefore, in a case where the watch 2 is in the rotation restrained state S1, the stopper lever 70 is at the rotation restrained position P1, and the second day wheel jumper 60 is in the rotation restrained state Q1, the rotation of the second day wheel 40 in the direction C2 is actually prohibited and restrained even when an accidental external force is applied.

In this example, a gap G (FIG. 8) is provided between the inner pin-type engaging portion 75 of the stopper lever 70 and the engaging edge portion 66 of the jumper 60 in the normal state S1 so as to allow easy assembly and operation.

In contrast, at the second day wheel rotation allowing position P2, the stopper lever 70 is in a state in which the outer pin-type engaging portion 74 of the lever member 71 engages the depressed portions 36*b* on the inner side of the cam surface 36 of the first day wheel 30 so that the entire part is rotated in the direction D2, and the inner pin-type engaging portion 75 also assumes a position of being rotated in the direction D2. At this time, in a state in which the jump-and-stop claw portion 64 of the second day wheel jumper 60 climbs over the claw portion 46*a* of the jump-and-stop claw wheel portion 46 of the second day wheel 40 and the jump-and-stop claw portion 64 of the second day wheel jumper 60 is in the breaking point (rotation allowing state) Q2 of being displaced in the direction E2, a distal end portion 64*a* of the jump-and-stop claw portion 64 assumes a state or a position in which the distal end portion 64*a* of the jump-and-stop claw portion 64 engages the distal end portion 46*a*1 of the claw portion 46*a* of the claw wheel portion 46. The jump-and-stop claw portion 64 of the second day wheel jumper 60 in this state Q2 engages or abuts against the inner pin-type engaging portion 75 of the stopper lever 70 at the position P2 on the engaging edge portion 66 on the back surface side thereof. In other words, when the stopper lever 70 is in the second day wheel rotation allowing position P2, the second day wheel jumper 60 assumes the second day wheel rotation allowing state Q2, and a state S2 in which the rotation of the second day wheel 40 is allowed (FIG. 2, FIG. 5, and FIG. 10).

As described later in detail, this rotation allowing state S2 is achieved only in a case of rotating the second day wheel 40 via the day intermediate wheel 50 with the first day wheel 30 at a specific rotational position.

As described above, when the stopper lever 70 is located at the rotational position P1 and the watch 2 is in the second day wheel rotation restrained (prohibited) state S1, the rotation of the first day wheel 30 is allowed, but the rotation of the second day wheel 40 is prohibited, so that only day advancement in the ones place is performed. In other words, the day advancement in the tens place is not performed. In contrast, when the stopper lever 70 is at the rotational position P2 and the watch 2 is in the second day wheel rotation allowing state S2, the rotation of the second day wheel 40 according to the rotation of the first day wheel 30 is allowed, and the day advancement in the tens place is performed according to the day advancement in the ones place. Here, the rotation of the first day wheel 30 is the same for the day advancement by the day advancing claw 53 and for the day advancement by the day correcting mechanism 20.

Subsequently, the operation of the day display apparatus 1 of the watch 2 according to a preferred embodiment of the present invention will be described on the basis of mainly FIG. 3 to FIG. 5 and FIG. 8 to FIG. 10 which are enlarged views of parts of FIG. 3 to FIG. 5, respectively, in conjunction with the day advancements of the first and second day wheels 30, 40.

When the date of the date portion 38 of the first day wheel 30 displayed in the day display window 16 (the date in the ones place) is in a range from 0 to 8 other than the 31st, as shown in FIG. 3, the tooth 34*a* of the second day wheel advancing tooth portion 34 as the program gear of the first day wheel 30 is positioned away from the day intermediate wheel 54. In FIG. 3, the date 15 is shown from the day display window 16 (the date having 5 as the numerical figure in the ones place). In this state S1, even though the day turning wheel 52 is rotated in the direction C1 according to the rotation of the hour wheel 12 (FIG. 1, and so on), and the first day wheel 30 is rotated by the day advancing claw 53 by one pitch (corresponding to one day) in the direction C1, the day intermediate wheel 54 is not rotated, and the second day wheel 40 is not rotated as well. The circumstances are the same in the case where the first day wheel 30 is rotated via the gear trains 22, 23, 24 of the day correcting mechanism 20 by the rotation of the winding stem 21 set to the predetermined pulled-out position instead of a case where the first day wheel 30 is rotated by the day advancing claw 53.

In this state S1, as is understood from FIG. 3 and FIG. 8, which shows a part of FIG. 3 in the enlarged scale, the second day wheel jumper 60 assumes the rotation restrained state Q1 in which the jump-and-stop claw portion 64 is fitted deeply between the adjacent claw portions 46*a*, 46*a* of the jump-and-stop claw wheel portion 46 of the second day wheel 40 in the direction E1, and the stopper lever 70 assumes the rotation restrained position P1 close to the engaging edge portion 66 on the back surface side of the jump-and-stop claw portion 64 of the second day wheel jumper 60 thereof to such extent that the inner pin-type engaging portion 75 is able to engage therewith in a state in which the outer pin-type engaging portion 74 engages the arcuate portion 36*a* of the cam surface 36 of the first day wheel 30 and hence is rotated in the direction D1.

In other words, in this state S1, disengagement of the jump-and-stop claw portion 64 of the jumper 60 which restrains the rotation of the second day wheel 40 from the rotation restrained state Q1 is prohibited by the position P1 of the stopper lever 70 positioned behind. Therefore, even when the watch 2 receives the accidental external force by the drop or the like, the risk of rotation of the second day wheel 40 is actually eliminated.

Subsequently, a case where the state in which the date is to be carried up will occur soon is assumed. For example, as shown in FIG. 4, when the time reaches about the end of "the 29th", that is, a little before 12 o'clock of the night (12 o'clock p.m.), the day advancing claw 53 of the day turning wheel 52 approaches the tooth portions 37*a* of the gear portion 37 of the first day wheel 30. In this state before the day advancement is started, the rotation of the second day wheel 40 is in the rotation restrained state S1 in the same manner as in FIG. 3.

Figure 4:
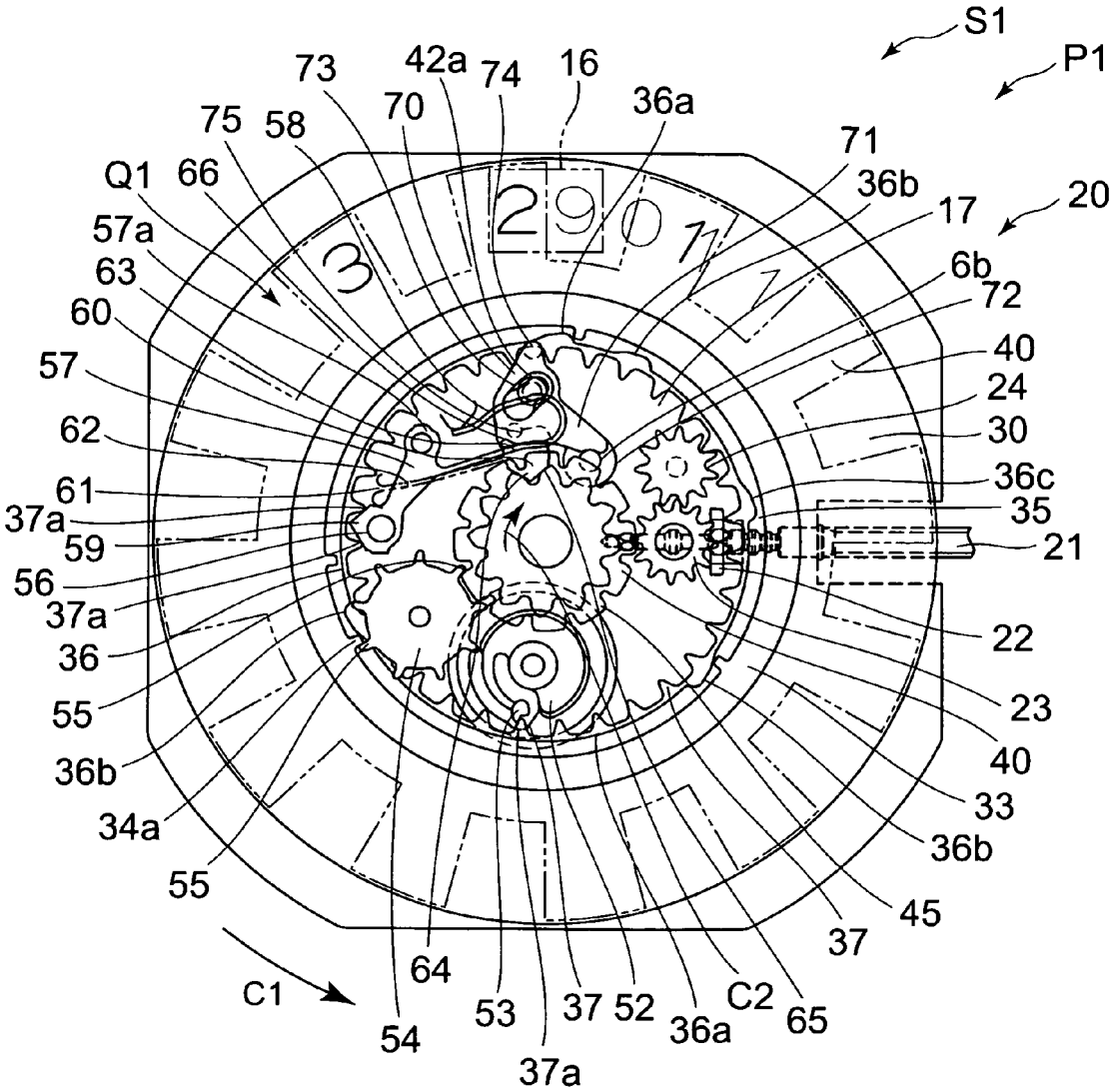
FIG. 4 is an explanatory plan view viewing along the line III-III of the watch in FIG. 1 at a timing when the rotation of the second day wheel is about to start (timing when the rotation of the second day wheel does not actually occur) like in FIG. 3.
Figure 9:
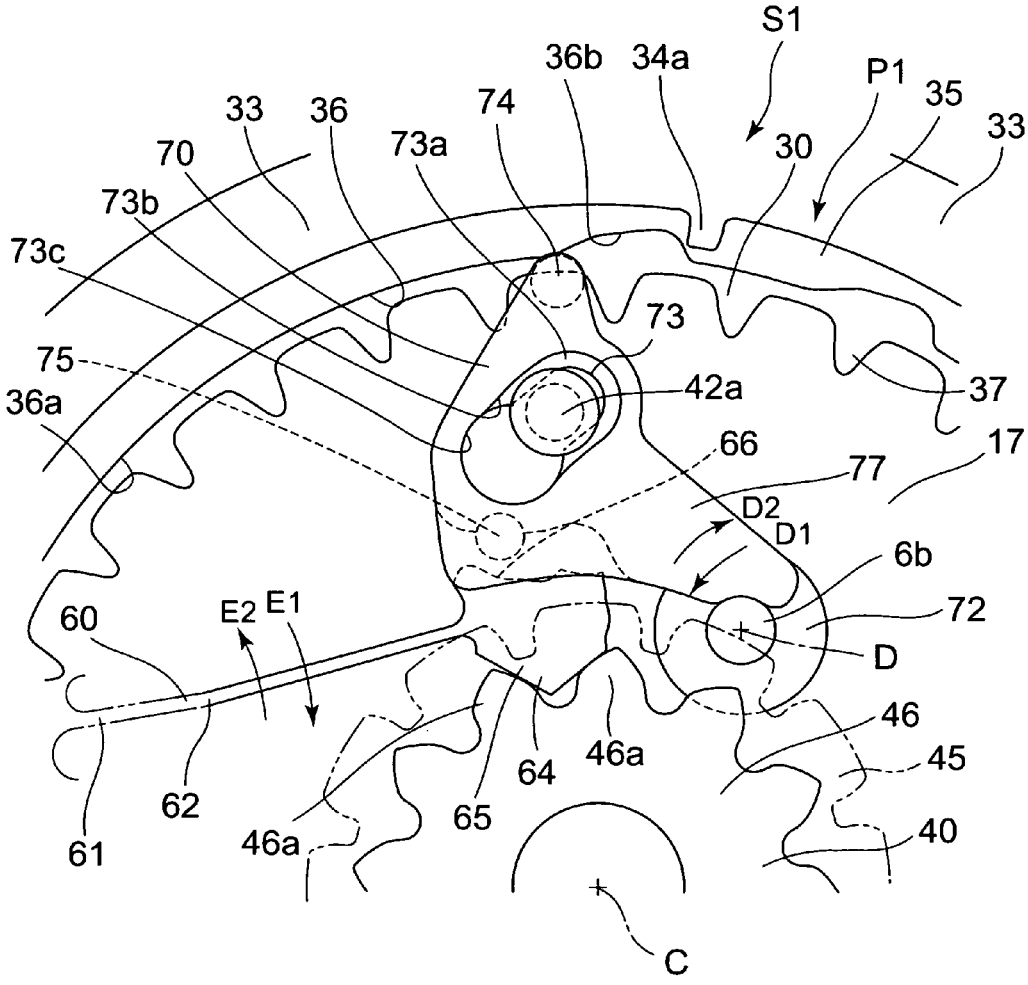
FIG. 9 is an enlarged explanatory plan view as in FIG. 8 showing about a timing (state) at which the rotation of the second day wheel is about to start as in FIG. 4.

In other words, as is understood from FIG. 4 and FIG. 9, which is an enlarged view of FIG. 4, the second day wheel jumper 60 is in the state Q1, and the body 65 of the jump-and-stop claw portion 64 is fitted between the adjacent claw portions 46*a*, 46*a* of the jump-and-stop claw wheel portion 46 of the second day wheel 40, and restrains the rotation of second day wheel 40 in the direction C2. In contrast, in this state S1, the stopper lever 70 assumes the position P1 in which the inner pin-type engaging portion 75 engages the engaging edge portion 66 on the back surface side of the jump-and-stop claw portion 64 of the second day wheel jumper 60, and the outer pin-type engaging portion 74 engages the arcuate portion 36*a* of the cam surface 36 of the first day wheel 30. In other words, the stopper lever 70 actually prohibited or restrained from rotating in the direction D2 by the engagement of the outer pin-type engaging portion 74 with the arcuate portion 36*a* of the cam surface 36 of the first day wheel 30 engages the engaging edge portion 66 on the back surface side of the jump-and-stop claw portion 64 of the second day wheel jumper 60 by the inner pin-type engaging portion 75, so that there is no risk of disengagement of the jump-and-stop claw portion 64 of the second day wheel jumper 60 from between the adjacent claw portions 46*a*, 46*a* of the jump-and-stop claw wheel portion 46 of the second day wheel 40 even though the impact caused by the drop or other accidental external forces are applied, so that the risk of occurrence of the accidental rotation in the second day wheel 40 is actually eliminated.

In this state, as described above, for example, when the time reaches about the end of "the 29th", for example, a little before 12 o'clock of the night, if the day advancing claw 53 starts to rotate the first day wheel 30 in the direction C1 by the rotation of the day advancing claw 53 in association with the rotation of the day turning wheel 52, as shown in FIG. 4, the projecting tooth portion 34*a* of the second day wheel advancing tooth portion 34 which constitutes the program gear of the first day wheel 30 engages the tooth portion 55 of the day intermediate wheel 54, so that the day intermediate wheel 54 is started to rotate in the direction C2.

As shown in FIG. 5, when the projecting tooth portion 34*a* of the first day wheel 30 engages the tooth portion 55 of the day intermediate wheel 54 to start rotating the day intermediate wheel 54 in the direction C1 according to the advancement of the rotation of the gear portion 37 of the first day wheel 30 in the direction C1 by the day advancing claw 53 (or the day correcting gear 24 of the day correcting mechanism 20), the driven gear portion 45 of the second day wheel 40 engaged with the tooth portion 55 of the day intermediate wheel 54 starts to rotate in the direction C2.

Here, since the depressed portions 36*b* of the cam surface 36 of the first day wheel 30 opposes the outer pin-type engaging portion 74 of the stopper lever 70 to allow the retraction or fitting of the outer pin-type engaging portion 74 into the depressed portions 36*b* according to the rotation of the first day wheel 30 in the direction C1, the rotation of the stopper lever 70 in the direction D2 is allowed. In contrast, as is understood from FIG. 5, as well as FIG. 10, which shows a part of FIG. 5 in an enlarged view, when the day intermediate wheel 54 rotates in the direction C1, the driven gear portion 45 of the second day wheel 40 which engages the day intermediate wheel 54 rotates in the direction C2. Therefore, the jump-and-stop claw portion 64 of the second day wheel jumper 60 is displaced outward in the direction E2, and the inner pin-type engaging portion 75 of the stopper lever 70 is pressed by the engaging edge portion 66 on the back surface side of the jump-and-stop claw portion 64 and is rotated in the direction D2 in association with the displacement of the jump-and-stop claw portion 64 in the direction E2, and the stopper lever 70 is rotated in the direction D2.

Here, as shown in FIG. 5 and FIG. 10, when the distal end portion of the body 65 of the jump-and-stop claw portion 64 of the second day wheel jumper 60 climbs over the distal end of the claw portion 46*a* of the jump-and-stop claw wheel portion 46 of the second day wheel 40, the jump-and-stop claw portion 64 of the second day wheel jumper 60 is displaced radially outward in the direction E2 to the maximum. The displacement of the jump-and-stop claw portion 64 of the second day wheel jumper 60 in the direction E2 is allowed by the outer pin-type engaging portion 74 fitted into the bottom of the depressed portions 36*b* of the cam surface 36 of the first day wheel 30 in the direction D2. In other words, the rotation of the second day wheel 40 in the direction C2 is allowed only when the first day wheel 30 is at a specific rotational position and the outer pin-type engaging portion 74 of the stopper lever 70 is fitted into the bottom of the depressed portions 36*b* of the cam surface 36 of the first day wheel 30, and the stopper lever 70 actually restrains the rotation of the second day wheel 40 unless otherwise the first day wheel 30 is at the specific rotational position. The specific rotational position is a midpoint of the day advancement in which "9" on the first day wheel 30 leaves the day display window 16 and "0" starts to enter the day display window 16. When the first day wheel 30 is at this specific rotational position and the second day wheel 40 rotates, the numeric value in the tens place is in the course of changing from "2" to "3".

When the advancement is further proceeded, for example, it assumes a state in which the day advancement is completed, this state is actually the same as the state S1 shown in FIG. 3 and FIG. 8 except for the point in which the date shown is "30".

In other words, the advancement of the first day wheel gear portion 37 in the direction C1 by the day advancing claw 53 is completed and the day advancing claw 53 is moved away from the tooth portions 37*a* of the gear portion 37 of the first day wheel 30. Therefore, the rotation of the first day wheel 30 in the direction C1 is terminated once. At this time, a day display section of the first day wheel 30 assumes a position where the "0" is displayed in the day display window 16 as the date 38 in the ones place. In contrast, in this state P1, the projecting tooth portion 34*a* of the second day wheel advancing tooth portion 34 of the first day wheel 30, which works as the program gear, passes by the tooth portion of the day intermediate wheel 54, and the engagement with the day intermediate wheel 54 is released, so that the rotation of the day intermediate wheel 54 is stopped. Consequently, the rotation of the second day wheel 40 which engages the day intermediate wheel 54 in the direction C2 is also stopped once. In this position where the second day wheel 40 assumes a state of being stopped once, the day display section of the second day wheel 40 assumes a position where "3" is displayed in the day display window 16 as the date 47 in the tens place. In other words, in the state P1 shown in FIG. 5, a state in which the carry-up of the date is completed, and the date "30" is displayed in the day display window 16 is assumed.

In this state, the jump-and-stop claw portion 59 of the first day wheel jumper 56 is fitted between the tooth portions 37*a*, 37*a* of the gear portion 37 of the first day wheel 30, and the rotation of the first day wheel 30 is restrained. In contrast, the claw body 65 of the jump-and-stop claw portion 64 of the second day wheel jumper 60 is fitted between the claw portions 46*a*, 46*a* of the claw wheel portion 46 of the second day wheel 40 and the rotation of the second day wheel 40 is restrained.

In this state, the outer pin-type engaging portion 74 of the stopper lever 70 is pushed out from the depressed portions 36*b* of the cam surface 36 of the first day wheel 30 and comes into abutment with the arcuate portion 36*a* of the cam surface 36 as a result of the rotation of the first day wheel 30 in the direction C1. In other words, the stopper lever 70 assumes a position of being rotated in the direction D1 by the cam 36. In this case, when the distal end portion of the body 65 of the jump-and-stop claw portion 64 of the second day wheel jumper 60 climbs over the distal end of the claw portion 46*a* corresponding to the jump-and-stop claw wheel portion 46 of the second day wheel 40, the second day wheel jumper 60 is fitted between the claw portion 46*a* and the next claw portion 46*a* by the resilient force of the spring portion 62, so that the engaging edge portion 66 on the back surface side of the jump-and-stop claw portion 64 of the second day wheel jumper may be retracted actually in the direction D1, so that the stopper lever 70 may be displaced in the direction D1 by a predetermined amount without being interfered by the second day wheel jumper 60.

What is claimed is:

1. A day display apparatus comprising:

a first day display wheel having a program tooth portion;

a second day display wheel having a claw wheel portion and a gear portion being rotatable coaxially with respect to the first day display wheel;

a second day display wheel jumper having a jump-and-stop claw portion and a spring portion, the jump-and-stop claw portion performing a jump-and-stop operation with respect to the claw wheel portion of the second day display wheel under an action of the spring portion;

a day intermediate wheel engaging the gear portion of the second day display wheel and being configured to be rotated by the program tooth portion of the first day display wheel every time when the first day display wheel reaches a predetermined rotational position and transmit the rotation to the second day display wheel; and a jump-and-stop control means which assumes a rotation restrained state which restrains the jump-and-stop claw portion from coming apart from between adjacent claw portions of the claw wheel portion when the jump-and-stop claw portion of the second day display wheel jumper is in a restrained position of being fitted between the adjacent claw portions of the claw wheel portion of the second day display wheel and assumes a rotation allowing state which allows the jump-and-stop claw portion to come apart from the adjacent claw portions of the claw wheel portion and climb over the claw portion of the claw wheel portion so as to allow the rotation of the second day display wheel every time when the first day display wheel reaches the predetermined rotational position.

2. A day display apparatus according to claim 1, wherein the first day display wheel includes a cam portion having an arcuate portion and a depressed portion, the jump-and-stop control means includes the cam portion and a jump-and-stop control mechanism, the jump-and-stop control mechanism assumes the rotation restrained position when the jump-and-stop control means assumes the rotation restrained state, the jump-and-stop control mechanism assumes a rotation allowing position when the jump-and-stop control means assumes the rotation allowing state, the jump-and-stop control mechanism being at the rotation restrained position engages the arcuate portion of the cam portion to restrain the jump-and-stop claw portion of the second day display wheel jumper from coming apart from between the adjacent claw portions of the claw wheel portion of the second day display wheel, and the jump-and-stop control mechanism being at the rotation allowing position engages the depressed portion of the cam portion to cause the jump-and-stop claw portion of the second day display wheel jumper to come apart from between the adjacent claw portions of the claw wheel portion of the second day display wheel and allows the second day display wheel to rotate.

3. A day display apparatus according to claim 2, wherein the program tooth portion of the first day display wheel opposes the gear portion of the second day display wheel via an annular area, and the day intermediate wheel is positioned in the annular area so as to transmit the rotation of the first day display wheel every time when reaching the predetermined rotational position to the second day display wheel, and the jump-and-stop control mechanism includes a stopper member having a cam engaging portion engaged with the arcuate portion of the cam member at the rotation restrained position and engaged with the depressed portion of the cam portion at the rotation allowing position and a jumper jump-and-stop claw engaging portion positioned at a portion opposing the back surface side of the jump-and-stop claw portion of the second day wheel jumper.

4. A day display apparatus according to claim 3, wherein the stopper member allows the jump-and-stop claw portion of the second day display wheel jumper to retract and climb over the claw portion of the claw wheel portion of the second day display wheel when assuming the rotation allowing position of being engaged with the depressed portion of the cam portion, and restrains the retraction of the back surface of the jump-and-stop claw portion of the second day display wheel jumper and retrains the jump-and-stop claw portion from climbing over the claw portion of the claw wheel portion of the second day display wheel when assuming the rotation restrained position of being engaged with the arcuate portion of the cam portion.

5. A day display apparatus according to claim 2, wherein the stopper member is rotatable between the rotation restrained position and the rotation allowing position.

6. A day display apparatus according to claim 3, wherein the stopper member is rotatable between the rotation restrained position and the rotation allowing position.

7. A day display apparatus according to claim 4, wherein the stopper member is rotatable between the rotation restrained position and the rotation allowing position.

8. A day display apparatus according to claim 5, wherein the stopper member is rotatable between the rotation restrained position and the rotation allowing position, and the stopper member includes an elongated hole for guiding the displacement of the stopper member in such a manner that the jumper jump-and-stop claw engaging portion and the cam engaging portion are displaced in the radial direction when the stopper member is rotated.

9. A day display apparatus according to claim 6, wherein the stopper member is rotatable between the rotation restrained position and the rotation allowing position, and the stopper member includes an elongated hole for guiding the displacement of the stopper member in such a manner that the jumper jump-and-stop claw engaging portion and the cam engaging portion are displaced in the radial direction when the stopper member is rotated.

10. A day display apparatus according to claim 7, wherein the stopper member is rotatable between the rotation restrained position and the rotation allowing position, and the stopper member includes an elongated hole for guiding the displacement of the stopper member in such a manner that the jumper jump-and-stop claw engaging portion and the cam engaging portion are displaced in the radial direction when the stopper member is rotated.

11. A day display apparatus according to claim 8, wherein the cam engaging portion has a pin-shape elongated in the direction of thickness of the first day display wheel.

12. A day display apparatus according to claim 9, wherein the cam engaging portion has a pin-shape elongated in the direction of thickness of the first day display wheel.

13. A day display apparatus according to claim 10, wherein the cam engaging portion has a pin-shape elongated in the direction of thickness of the first day display wheel.

14. A day display apparatus according to claim 8, wherein the jumper jump-and-stop claw engaging portion has a pin-shape elongated in the direction of thickness of the second day display wheel.

15. A day display apparatus according to claim 9, wherein the jumper jump-and-stop claw engaging portion has a pin-shape elongated in the direction of thickness of the second day display wheel.

16. A day display apparatus according to claim 10, wherein the jumper jump-and-stop claw engaging portion has a pin-shape elongated in the direction of thickness of the second day display wheel.

17. A day display apparatus according to claim 1, the first day display wheel includes a claw wheel, and the claw wheel of the first day display wheel is restrained by a first day display wheel jumper.

18. A day display apparatus according to claim 1, wherein the first day display wheel displays the ones place of the date, and the second day display wheel displays the tens place of the date.

19. A watch comprising the day display apparatus according to claim 1.

* * * * *